United States Patent [19]

Anderson

[11] Patent Number: 4,703,707

[45] Date of Patent: Nov. 3, 1987

[54] SAILS AND SAILING VESSELS

[76] Inventor: Thomas R. Anderson, 43 Kulgoa Ave., Ryde, New South Wales, Australia

[21] Appl. No.: 851,216

[22] Filed: Apr. 14, 1986

[51] Int. Cl.[4] ..... B63H 9/06

[52] U.S. Cl. ..... 114/102; 114/103

[58] Field of Search ..... 114/39, 39.2, 91, 102, 114/103

[56] References Cited

U.S. PATENT DOCUMENTS

| | | | |
|---|---|---|---|
| 2,561,253 | 7/1951 | Wells-Coates | 114/102 |
| 3,557,733 | 1/1971 | Mathieu et al. | 114/102 |
| 4,064,821 | 12/1977 | Roberts, Jr. et al. | 114/103 X |
| 4,530,301 | 7/1985 | Latham | 114/102 |

FOREIGN PATENT DOCUMENTS

| | | | |
|---|---|---|---|
| 2436072 | 5/1980 | France | 114/103 |

*Primary Examiner*—Sherman D. Basinger
*Attorney, Agent, or Firm*—Anthony A. O'Brien

[57] ABSTRACT

A sail assembly comprising a mast, spaced apart lateral upper and a lower elongated members fixed to the mast, a track joining first ends of the upper and lower members, two panels of sail material one to each side of the mast connected to the track by runners to allow the sail panels to be furled, sail battens mounted in pockets in the two sail panels with the forward ends of the sail battens retained to resist longitudinal compressive forces when applied to the battens to induce a bend therein, battens in the respective sail panels are aligned to provide batten pairs with the rear ends of the battens of each pair where they project from the batten pockets interconnected but relatively movable, and a line and pulley arrangement longitudinal compressive force to the sail battens at a location remote from the forward ends thereof.

5 Claims, 7 Drawing Figures

SAILS AND SAILING VESSELS

This invention provides a novel sail assembly which includes a closed sail envelope which can be varied in profile to take the best advantage of prevailing wind conditions. The assembly can also be moved rotationaly to allow the angle of attack of the leading edge of the sail envelope to the wind to be varied.

As will be understood a sail having the above capabilities will provide a wide range of adjustment possibilities for the sailor and will allow the prevailing winds to used to maximum advantage.

The invention can be broadly said to comprise a sail assembly comprising a mast, parallel upper and lower elongated members fixed to and substantially normal to the mast between the mid-length positions and corresponding first ends of the members, connector means including track means joining the first ends of the members, flexible sail forming sheet material joined to the track means by runners and extending as two panels with terminal rear edges adjacent to the other ends of said members and with the mast between the panels, pairs of elongated flexible sail profiling elements with corresponding elements of said pairs mounted in the respective sail panels, sliding joints between exposed rear ends of the elements of said pairs at or adjacent the rear edges of said panels, and means to apply bending pressure to said elements by the application of longitudinal compressive forces to said elements.

Figure 1:
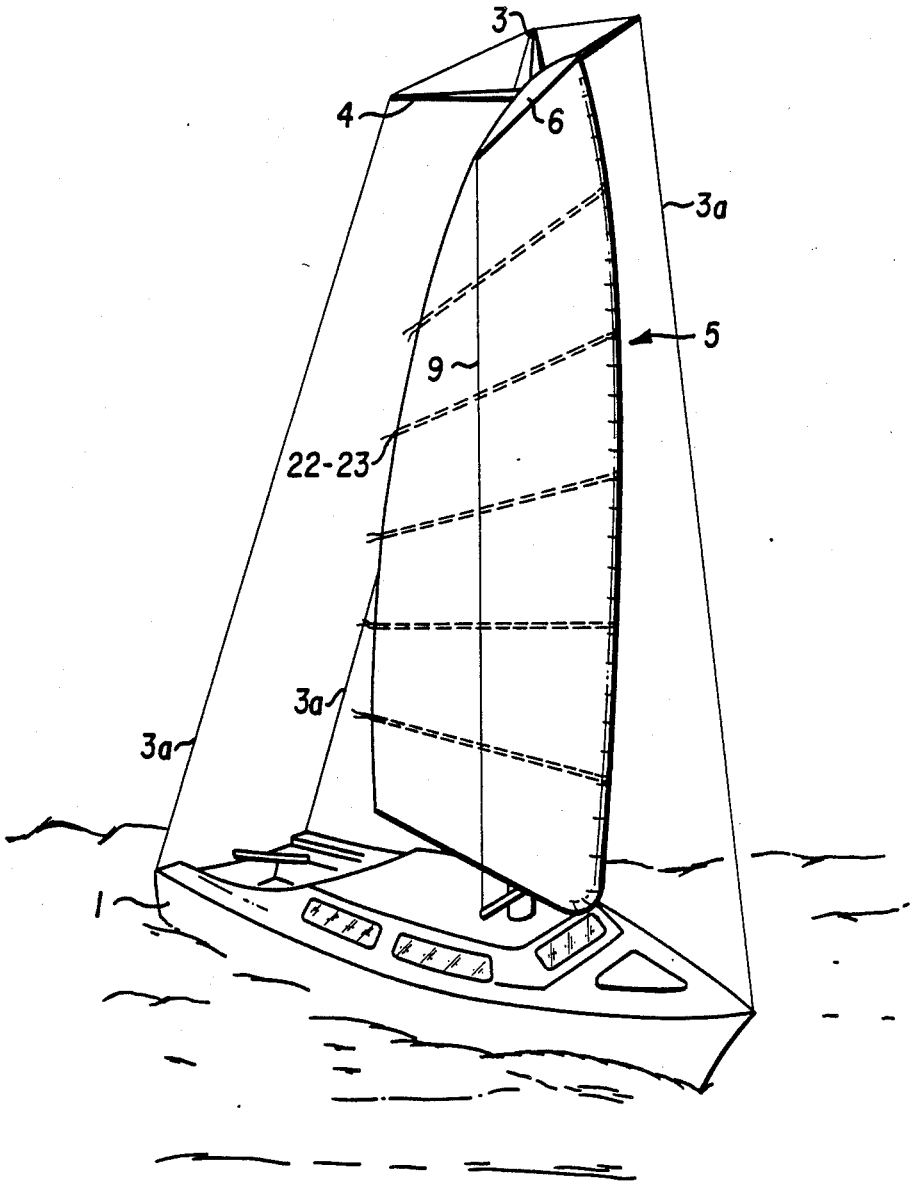
Figure 2:
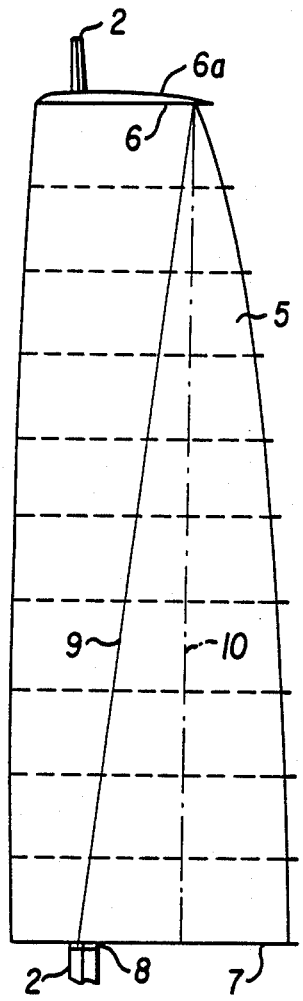
Figure 3:
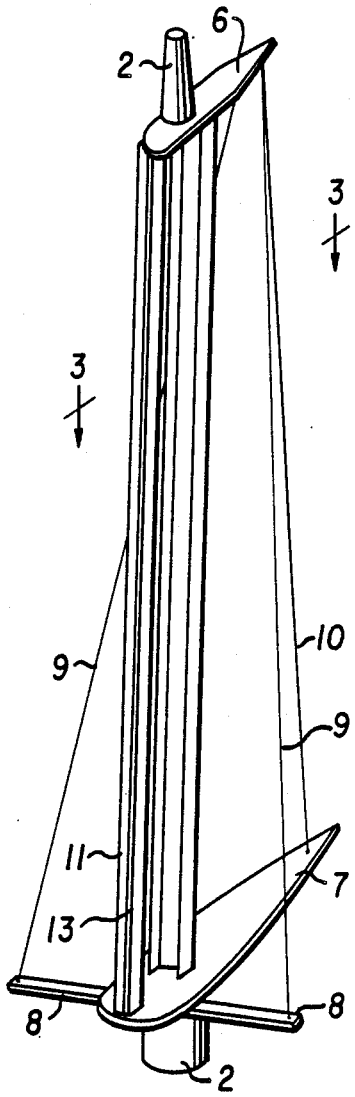
Figure 4:
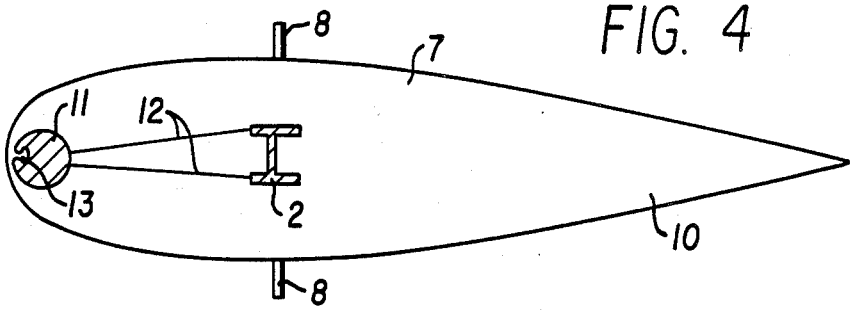
Figure 5:
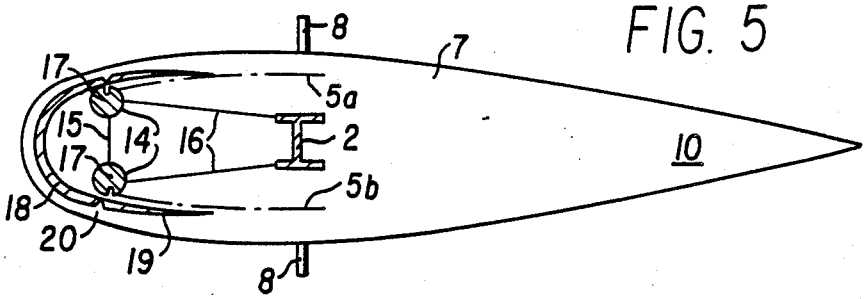
Figure 6:
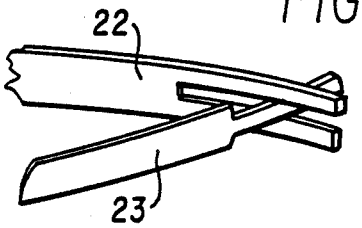
Figure 7:
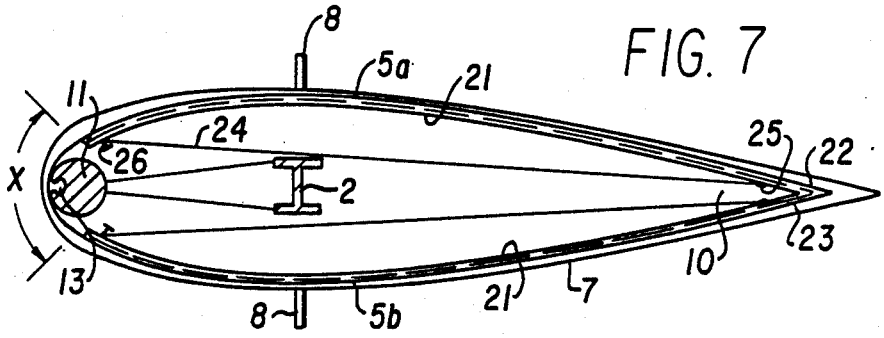

Presently preferred forms of the invention will now be described with reference to the accompanying drawings in which:

FIG. 1 is a perspective view of a typical arrangement showing a conventional boat hull fitted with the sail assembly, FIG. 2 is a schematic side view of the sail asembly, FIG. 3 is a perspective view of the basic components of the sail assembly with the sail cloth removed, FIG. 4 is a cross-section on section line 3—3 of FIG. 3, FIG. 5 is a view similar to FIG. 4 of a second form of the invention, FIG. 6 is a perspective view of a preferred form of an end connection between sail battens of the sail panels forming the sail envelope as proposed by the invention and FIG. 7 is a view similar to FIG. 4 showing one means for forming the sail envelope into an aerofoil shape of desired cross-section.

Referring to the drawings, FIG. 1 illustrates a boat hull 1 with a rotatably mounted mast 2 thereon. The manner of mast mounting so as to be rotatable and the means to provide rotation can be of many forms and as no inventive ingenuity is required to provide these features no preferred arrangement has been described. Braces indicated 3 and shrouds 3*a* from a cross arm assembly 4 rotatably mounted on the mast stabilise the top of the mast. A sail envelope generally indicated 5 is mounted so as to enclose the major portion of the mast.

Referring to FIG. 2, the sail is shown as having a pronounced curvature in the trailing edge of the sail. It is preferred that the leading edge of the sail is also an arc of a circle. Benefits result when the leading and trailing edges of the sail are so formed in that at any stage in a sail raising and lowering operation the sail shape is still substantially a section of the preferred sail panel shape as illustrated. FIG. 3 shows that the mast is, in the preferred form, of H section in the central portion with other shapes ends. The mast may have other shapes and may be of uniform shape throughout its length and may also be tapered, as shown in the drawings.

Adjacent the top of the mast 2 an upper sail end 6 is provided and a like but larger sail end 7 is fixed to the mast 2 adjacent its lower end. Preferably there is a hood of streamlined form 6*a* (see FIG. 2) over the top of the end 6. The mast is positioned approximately 20 to 30 percent of the distance along the chord length of the members 6 and 7 to assist the sail assembly in weather cocking. Fixed to the mast and/or the end 7 there are two arms 8 and assembly stabilising and bracing wires or other tensioned elements indicated 9 extend from the arms 8 to the tail end of the member 6. There is also another assembly bracing like member 10 extending from the end 7 to the end 6.

The sail is a envelope and can be varied in profile to adopt a range of aerofoil shapes. The ends 6 and 7 in shape and size are such as to always cover the ends of the sail envelope for substantially all possible shapes. Whilst this is a desirable feature the invention is not limited to the ends 6 and 7 having the preferred shapes described.

In FIGS. 3 and 4 a preferred form of leading edge sail support is illustrated, it comprises an elongated member 11 preferably having a curvature along its length. The curvature may be induced by varying the length of ties 12 connecting the member 11 to the mast 2. Along the leading edge of the member 11 there is a track 13 of suitable form to accept runners in a captive manner whereby the sail cloth is attached to the member 11. Suitable halyards are provided to permit the raising and lowering of the sail relative to the member 11.

FIG. 5 illustrates another form of leading edge sail support means which comprises two elongated members 14 with the members held in spaced relationship at intervals along the length of the members by cross ties 15 and tied to the mast 2 by ties 16 in a manner to provide the preferred curvature of the members 14. The members 14 have tracks 17 along their length to hold captive runners whereby the leading edges of two panels of sail cloth are attached to the members 14. In an alternative arrangement the members 14 could be wires and the sail could have slides to run on the wires.

FIG. 5 also shows a nosing indicated 18 which extends from the end 6 to the end 7 to provide a streamlined leading edge for the sail assembly. This was not needed in the FIG. 4 arrangement where the sail cloth passes around the smooth profile of the member 11 to give the leading edge of the sail the required steamlined form. It is to be noted that there are flaps 19 connected by reduced section parts 20, providing a hinge effect, extending rearwardly from the member 18. The flaps are preferably of the form shown but could be flaps of sail cloth on the like fixed to the trailing edges of the member 18. The purpose of the flaps is to provide a smooth transition from the shape of the nosing 18 to the sides of the sail profile and so encourage turbulance free flow of air over the sail profile. In an alternative arrangement the legs of the U member 18 could be longer and of shape similar to the flaps 19 and could be from a flexible plastics or like material. The extended legs could then deflect to provide the required transitional blending of the shape of the member 18 to the shape of the sail panels. In yet another arrangement the member 18 could be pivotally mounted on members 6 and 7 allowing it to move with the sail profile changes to provide the required transitional blending of the shape of the member 18 to the shape of the sail panels.

As mentioned above the sail cloth can be in one piece fastened at approximately mid-length to the member 11 or in two pieces fastened at their leading edges to the members 14. In both cases there are two panels of sail cloth passing one to each side of the mast 2 and the line 10. In order to provide and manintain the required contour of the sail leading edge around the member 11 of the FIG. 4 and 7 arrangements the portion in the zone X of FIG. 7 is reinforced and stiffened, as by providing a number of layers of sail cloth in that zone or by the inclusion of a shaped fibreglass or like stiffening member.

The shaping of the sail panels is achieved by battens or batten like members housed in batten pockets on the inner faces of the sail panels. Referring to FIG. 7 it will be seen that a sheet of sail cloth is fastened at its mid length position by runners in the track 13 of the member 11. There are two sail panels 5*a* and 5*b* passing one to either side of the mast 2. On the inner surfaces of the panels there are batten pockets 21 which are blind at the ends adjacent the member 11 and open at the rear edges of the panels 5*a* and 5*b*. The batten pockets of the panels 5*a* and 5*b* are in pairs and battens 22 and 23 in the pockets of the panels 5*a* and 5*b* extend from the open ends of the batten pockets and are joined as by a tongue and slot arrangement as shown in FIG. 6. The tongue and slot arrangement is illustrative and other "joints" permitting relative sliding movement between the ends of the battens can be used.

By applying longitudinal compressive loads on the battens 22 and 23 they will be caused to bend. This is shown in FIG. 7 where there is a convex curvature in the panel 5*a* of smaller radius than there is for the panel 5*b*. The compressive loads can be applied in several ways. In the preferred way, as shown in FIG. 7, lines 24 are anchored at 25 to the outer faces of the batten pockets adjacent the rear edges of the said panels 5*a* and 5*b* and are passed over pulleys 26 on the outer faces of the batten pockets adjacent the member 11. The lines 24 then pass downwardly to the deck of the boat and tension is applied in any suitable manner. For example by hydraulic means attached to a head member to which the ends of all of the lines of one or other of the sail panels are anchored. Mechanical means such as levers or pulleys can alternatively be used. By tensioning all of the lines of a given sail panel the associated battens will, because of their lengths, profiles and cross-sections, adopt a predetermined curvature and the sail panel will adopt a predetermined shape.

In another load applying method (not illustrated) there is a leech line connecting the ends of the battens in the panel 5*a* and another connecting the ends of the battens in the sail panel 5*b*. The upper ends of the leech lines are fixed to the member 6, which is braced through the braces 3 back to the mast 2. The leech lines lie on a curve, due to the different lengths of the battens, and consequently tension applied to the leech lines from a tensioning means on the boat deck to straighten the curve in a leech line will cause the battens to "bow". The degree of bow induced in the battens will provide a corresponding sail panel curvature.

The foregoing is a description of several embodiments of the invention with preferred arrangements of members. It is to be understood that the members described can be varied without departing from the concept of the invention which is detailed in the following claims.

I claim:

1. A sail assembly comprising a mast, an upper elongated member fixed laterally to the mast, a lower elongated member fixed laterally to the mast and parallel to the upper elongated member, the points of fixing of the upper and lower elongated member to the mast are between the midlengths of the upper and lower members and first ends of those members, connector means comprising a pair of elongated tie members joining the first ends of the upper and lower elongated members, track means in each of the tie members, two panels of sail cloth disposed one to each side of the mast with leading edges adjacent the tie members and terminal edges adjacent the other ends of the upper and lower elongated members, runners on the leading edge of each sail panel with the runners of the sail panels engaged in the track means of the respective tie members, pairs of flexible elongated sail profiling elements with corresponding elements of the pairs mounted in elongated pockets in the respective sail panels so as to lie parallel to and between the upper and lower members with the forward ends of the profiling elements anchored and the trailing ends of the profiling elements extending from the elongated pockets at the terminal edges of the sail panels, means for interconnecting the trailing ends of each pair of profiling elements to allow relative longitudinal movement therebetween and means to apply bending pressure to the profiling elements by the application of longitudinal compressive forces to sail elements.

2. A sail assembly as claimed in claim 1 including en elongated nosing having a generally U shaped body which partially embraces the connector means and covers the track means thereof to provide a streamlined leading edge for the said assembly.

3. A sail assembly as claimed in claim 2 wherein the nosing is mounted for part rotation about a long axis of the nosing.

4. A sail assembly as claimed in claim 3 wherein the nosing has flap extensions of the legs of the U shaped body to provide streamlined bridging between the profile of the nosing and the profile of the sail panels.

5. A sail assembly as claimed in claim 2 wherein the nosing has flap extensions of the legs of the U shaped body to provide streamlined bridging between the profile of the nosing and the profile of the sail panels.

* * * * *